United States Patent [19]

Heller

[11] Patent Number: 4,921,257

[45] Date of Patent: May 1, 1990

[54] SOCCER TRAINING DEVICE

[76] Inventor: Stephen J. Heller, 9111 Windy Crest, Dallas, Tex. 75243

[21] Appl. No.: 221,271

[22] Filed: Jul. 19, 1988

[51] Int. Cl.[5] ..... A63B 63/00; A63B 69/00

[52] U.S. Cl. ..... 273/401

[58] Field of Search ..... 273/401, 402, 400, 410, 273/181 A, 181 F, 182 R, 1 B, 395, 396

[56] References Cited

U.S. PATENT DOCUMENTS

| | | | |
|---|---|---|---|
| 2,873,969 | 2/1959 | Ziel | 273/402 X |
| 3,215,432 | 11/1965 | Lee et al. | 273/401 X |
| 3,558,140 | 1/1971 | Romeo | 273/410 X |
| 3,856,298 | 12/1974 | Frantti | 273/402 |
| 3,887,181 | 6/1975 | Samaras | 273/1 B |
| 3,944,223 | 3/1976 | Bromwell | 273/1 B |
| 4,188,031 | 2/1980 | Fox | 273/410 X |

FOREIGN PATENT DOCUMENTS

| | | | |
|---|---|---|---|
| 3239249 | 4/1984 | Fed. Rep. of Germany | 273/1 B |
| 3524715 | 1/1987 | Fed. Rep. of Germany | 273/401 |
| 10852 | 8/1887 | United Kingdom | 273/402 |

*Primary Examiner*—Paul E. Shapiro
*Attorney, Agent, or Firm*—W. Kirk McCord

[57] ABSTRACT

A soccer training device for training soccer players to direct their shots on goal to selected target areas within the goal opening. The device is adapted for use in connection with a conventional soccer goal having first and second vertical uprights and a horizontal cross member connecting the uprights for cooperating with a base surface beneath the goal to define a substantially rectangular goal opening. The device includes a flexible frame member for being attached to the first and second uprights and the cross member to circumscribe the perimeter of the goal opening and a relatively flat member coupled to the frame member. The flat member has a central portion extending along a minor axis of the goal opening from the base surface to the cross member and first and second wing portions extending outwardly along a major axis of the goal opening from the central portion to the respective first and second uprights when the device is attached to the soccer goal. The flat member is disposed within the perimeter of the goal opening to define selected apertures betweem the flat member and the frame member representing desired target areas within the goal opening through which a soccer player is trained to direct the ball. A flexible backing member is coupled to the frame member for substantially impeding the further progress of the soccer ball after the ball has been propelled through one of the selected apertures.

14 Claims, 3 Drawing Sheets

SOCCER TRAINING DEVICE

FIELD OF THE INVENTION

This invention relates generally to athletic training devices and in particular to a soccer training device for training players to kick the ball to target areas of the goal and goalies to defend selected areas of the goal.

BACKGROUND OF THE INVENTION

Soccer goals generally comprise a framework of two vertical uprights connected at their top by a horizontal cross member to define the goal opening. A loose fitting net may be connected along the upright's cross member to define a goal space. Additional diagonal frame members may be connected to the upright's cross member to better define the goal space. The entire structure is anchored to a playing field by means of spikes or the like in a conventional manner. In practicing the game of soccer, players are trained not only to kick the ball into the goal, but also to accurately kick the ball to selected target areas of the goal opening. Soccer goalies are trained to move laterally along the goal and outwardly therefrom to protect the goal by cutting off the shot angles.

DESCRIPTION OF THE PRIOR ART

According to prior practice, it is known to draw a representation of a goal opening on a hard vertical surface, such as a wall, and to practice kicking the ball at selected target locations on the wall. Such an arrangement provides for a quick return of the ball so that time is not wasted in fishing the ball out of the goal net, as would be the case when practicing with an actual soccer goal. One disadvantage, however, is that the ball hits the wall and returns so quickly that it will frequently be propelled past the player, which requires the player to chase down the ball in the opposite direction as it bounces off the wall. Another disadvantage of this configuration is that it is difficult to tell whether the player has kicked the ball to the proper target area on the wall because of the speed at which the ball caroms off of the wall.

U.S. Pat. No. 4,286,786 discloses a soccer training goal in which an inclined plate is connected to the goal frame at the bottom and is inclined downwardly toward the goal opening, whereby a soccer ball kicked into the goal space will initially be retained within the goal space by hitting the net. The net absorbs the impact of the ball and the ball then rolls down the inclined plate back to the practicing kicker. Other sports, such as baseball and golf, make use of practice devices, which involve the delivery of the ball to a target area on the practice device. Examples of these devices are shown in U.S. Pat. Nos. 2,059,365; 2,628,097; 3,195,898; 3,197,208; and 3,711,092.

OBJECTS OF THE INVENTION

It is, therefore, the principal object of the present invention to provide an improved soccer training device.

Another object of the invention is to provide a device for training soccer players to kick a soccer ball into selected target areas of the goal space.

Still another object of the invention is to provide a soccer training device which can be quickly and easily installed on an actual soccer goal.

A further object of the invention is to provide a soccer training device for attachment to a soccer goal, which allows the soccer ball to be quickly and conveniently retrieved after the ball has been kicked into the goal.

SUMMARY OF THE INVENTION

These and other objects are accomplished in accordance with the present invention wherein a soccer training device is adapted for use in connection with a soccer goal having first and second vertical uprights and a horizontal cross member connecting the uprights for cooperating with a base surface beneath the goal to define a substantially rectangular goal opening. The device is comprised of a frame member for being attached to the first and second uprights and the cross member to circumscribe the perimeter of the goal opening and a relatively flat member coupled to the frame member. The flat member has a central portion extending along a minor axis of the goal area from the base surface to the cross member and first and second wing portions extending outwardly along a major axis of the goal opening from the central portion to the respective first and second uprights when the frame member is attached to the soccer goal. The flat member is disposed within the perimeter of the goal opening to define selected apertures between the flat member and the frame member representing desired target areas within the goal opening to which a soccer player is trained to kick the ball.

In one embodiment the device further includes a flexible backing member coupled to the frame member for substantially impeding the further progress of the soccer ball after the ball has been propelled through one of the selected apertures. In another embodiment the backing member is attached along its perimeter to the frame member. The backing member has a greater area than the area of the goal opening so that the backing member fits loosely on the frame member behind the flat member to define a curved surface. In yet another embodiment the backing member is configured to absorb the impact of the soccer ball after the ball has been propelled through one of the apertures so as to substantially impede the further progress thereof and to prevent the ball from being reflected back through the particular aperture through which the ball was initially propelled, thereby trapping the ball between the flat member and the backing member to facilitate retrieval of the ball.

In the preferred embodiment the backing member is comprised of a net material having a predetermined mesh and the flat member is comprised of a solid canvas material. The central portion of the flat member preferably includes a graphic representation of a soccer goalie to simulate actual playing conditions. A plurality of straps are disposed at selected positions on the device for being wrapped around the corresponding uprights and cross member. A corresponding plurality of fasteners are provided for securing the corresponding straps after they have been wrapped around the corresponding uprights and cross member. The apertures representing the target areas within the goal opening are preferably comprised of four substantially trapezoidal-shaped openings positioned adjacent to the respective four corners of the rectangular goal opening.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

In the description which follows like parts are marked throughout the specification and drawings, respectively. The drawings are not necessarily to scale and in some instances proportions have been exaggerated in order to more clearly depict certain features of the invention.

Figure 1:
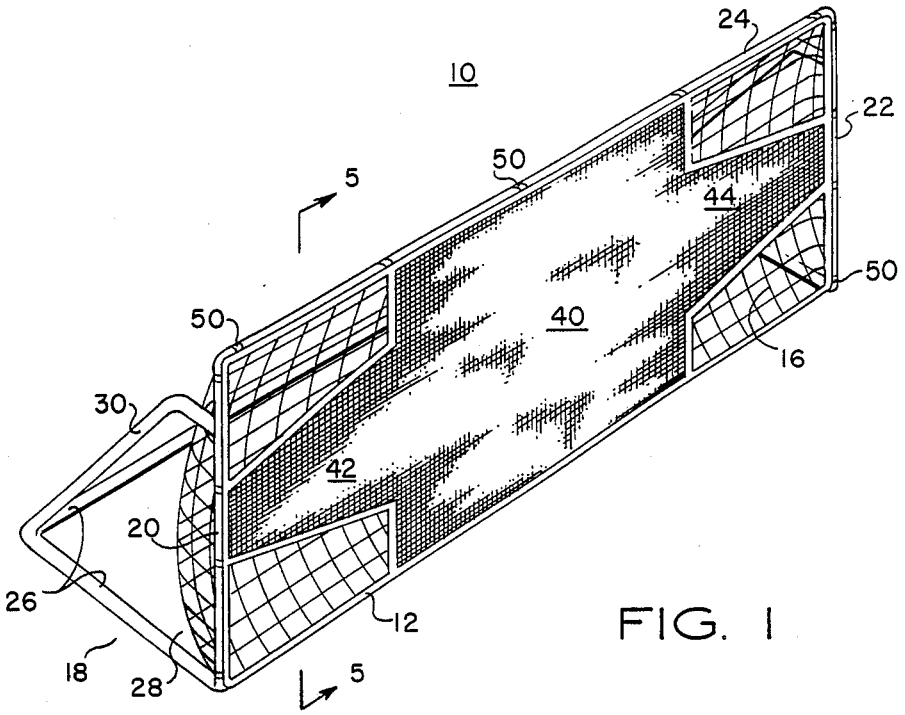
FIG. 1 is a perspective view of a soccer goal with the training device according to the present invention attached thereto.
Figure 2:
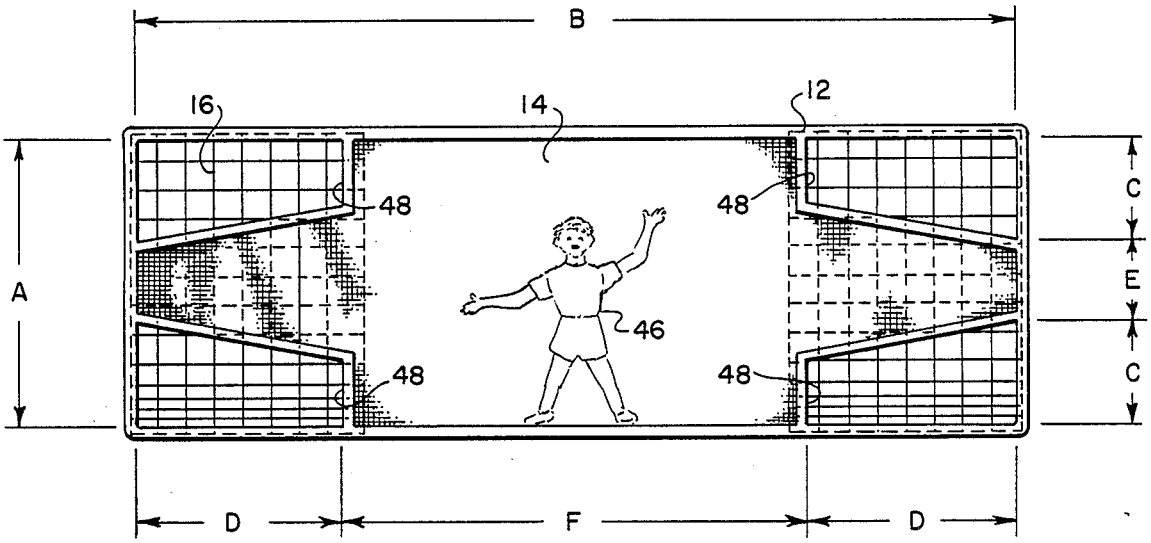
FIG. 2 is a front elevational view of the soccer goal with the training device according to the present invention attached thereto.

Referring to FIGS. 1 and 2, a soccer training device 10 according to the present invention is comprised of a flexible frame member 12, a relatively flat member 14 disposed within the perimeter of frame member 12 and a backing member 16, which is preferably comprised of a loose fitting net. Frame member 12 is preferably comprised of four relatively flat strips connected to define a substantially rectangular perimeter of device 10. Frame member 12 is adapted for connecting device 10 to a conventional soccer goal as will be described hereinafter in greater detail with reference to FIG. 3.

Figure 4:
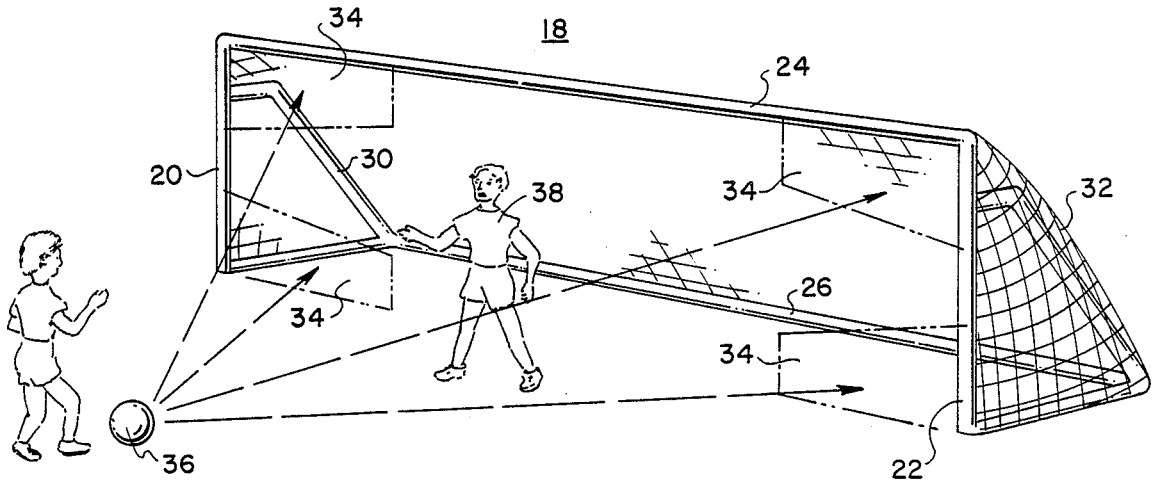
FIG. 4 is a perspective view of a conventional soccer goal, illustrating the desired target areas within the goal opening to which a soccer player is trained to kick the ball.

Referring also to FIG. 4, a conventional soccer goal 18 is typically comprised of first and second oppositely positioned vertical uprights 20 and 22, a horizontal cross member 24 connecting first and second uprights 20 and 22, three base members 26 defining three legs of a rectangle, which are in contact with a base surface 28, such as a soccer playing field, and a pair of diagonal braces 30 extending between corresponding first and second uprights 20 and 22 and the respective corners of the partial rectangle defined by base members 26. In the typical soccer goal a net 32 envelopes the back portion of the goal to trap soccer balls which are kicked into the goal.

First and second uprights 20 and 22 and cross member 24 cooperate with base surface 28 to define a rectangular goal opening, which is comprised of a portion of a vertical plane passing through cross member 24 and base surface 28. During a soccer game, a goal is scored when a ball penetrates the aforementioned vertical plane within the goal opening. After the ball penetrates the goal area, it is trapped in the back portion of the goal by net 32.

As best seen in FIG. 4, there are certain target areas 34 to which soccer players are trained to kick a soccer ball 36. Target areas 34 represent those areas adjacent to the four corners of the rectangular goal opening which a soccer goalie 38 cannot normally reach in order to prevent ball 36 from being kicked through the goal opening. As illustrated, target areas 34 have a substantially trapezoidal shape. The well-trained soccer player will maintain a mental picture of target areas 34 in order to properly direct his kicks when he is attempting to score a goal.

in accordance with the present invention, training device 10 is attached to a conventional soccer goal 18 to enhance the ability of soccer players to kick the ball to designated locations within the goal opening. This is accomplished by installing device 10 so that frame member 12 thereof is substantially coincident with the perimeter of the goal opening and flat member 14 is disposed within the perimeter of the goal opening. Flat member 14 is comprised of a substantially rectangular central portion 40 and a pair of depending first and second wing portions 42 and 44. Central portion 40 extends along a minor axis of the goal opening between base surface 28 and cross member 24 and first and second wing portions 42 and 44 extend in opposite directions along a major axis of the goal opening outwardly from central portion 40 to respective first and second uprights 20 and 22. First and second wing portions 42 and 44 are tapered downwardly from central portion 40 to the corresponding first and second uprights 20 and 22.

Flat member 14 is shaped so as to define four substantially trapezoidal-shaped apertures representing the aforementioned target areas 34 between flat member 14 and frame member 12. Flat member 14 is preferably comprised of a solid canvas material, which is flexible enough to be folded or rolled when device 10 is removed from goal 18 to facilitate storage of device 10. In one embodiment central portion 40 includes a graphic display 46 representing a soccer goalie to add realism when device 10 is being used for soccer practice. Graphic display 46 creates a visual image which simulates actual game conditions when a soccer goalie is guarding the goal area. Graphic display 46 also aids the goalie in maintaining his bearings during soccer practice. Young children in particular have a difficult time maintaining an awareness of the center of the goal. Display 46 helps the young goalie keep track of the center of the goal.

Referring to FIG. 2, the height of soccer goal 18, as represented by dimension A, is approximately 8 feet and the width thereof, as represented by dimension B, is approximately 24 feet. It has been found that each target area 34 will have a height of approximately 2 feet on its inner edge 48 and a height of approximately 3 feet at its outer edge along the corresponding upright 20 or 22, as represented by dimension C. The length of the straight leg portion of each target area 34 along frame member 12 will be approximately 6 feet, as represented by dimension D. From these dimensions, it follows that the width of each wing portion 42 and 44 along frame member 12 is on the order of 2 feet, as represented by dimension E, and the width of central portion 40 is on the order of 12 feet, as represented by dimension F. One skilled in the art will appreciate that the present invention is not limited to the aforestated dimensions for target areas 34, but that these dimensions represent typical dimensions for which device 10 can be configured to provide valuable player training.

Figure 5:
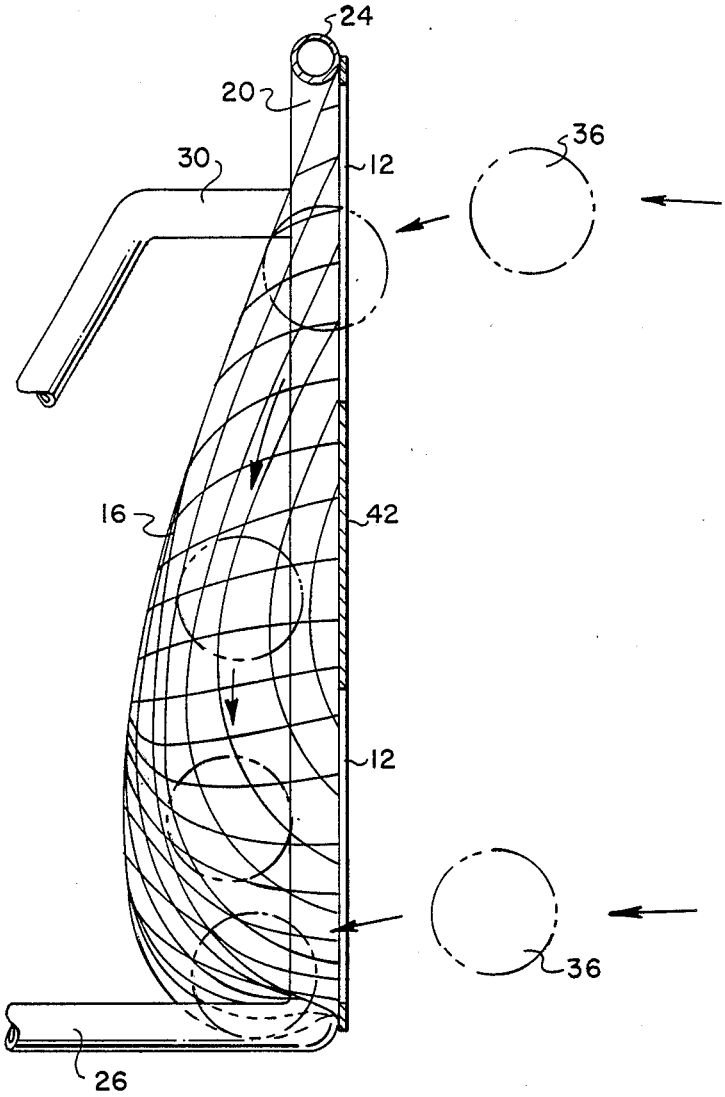
FIG. 5 is a sectional view taken along the line 5—5 in FIG. 1, illustrating a backing member which is used to impede the further progress of the soccer ball after the ball has been kicked through one of the target apertures in the training device according to the present invention so as to facilitate the retrieval of the ball.

Another aspect of the invention is illustrated in FIG. 5. Backing member 16 is preferably comprised of a net material having a predetermined mesh. Backing material 16 is coupled to frame member 12 for substantially impeding the further progress of soccer ball 36 after ball 36 is kicked through one of the openings representing a target area 34. Backing member !6 has a greater area than the area of the goal opening so that backing member 16 fits loosely on frame member 12 behind flat member 14 to define a curved surface. Backing member absorbs the impact of ball 36 after ball 36 has been propelled through one of the target apertures so as to impede the further progress thereof. If, for example, ball 36 is kicked through one of the target apertures at the top of the goal opening, backing member 16 will stop the forward momentum of ball 36 and cause ball 36 to fall toward base surface 28 between flat member 14 and backing member 16. Ball 36 will come to rest on base surface 28 between backing member 16 and flat member 14 adjacent to one of the lower target apertures. By the same token, if ball 36 is initially kicked through one of the lower target apertures, backing member 16 will absorb the impact thereof and cause ball 36 to come to rest between flat member 14 and backing member 16 adjacent to the same lower target aperture through which ball 36 was initially propelled. In this manner, ball 36 can be quickly and conveniently retrieved through one of the lower target apertures.

Figure 3:
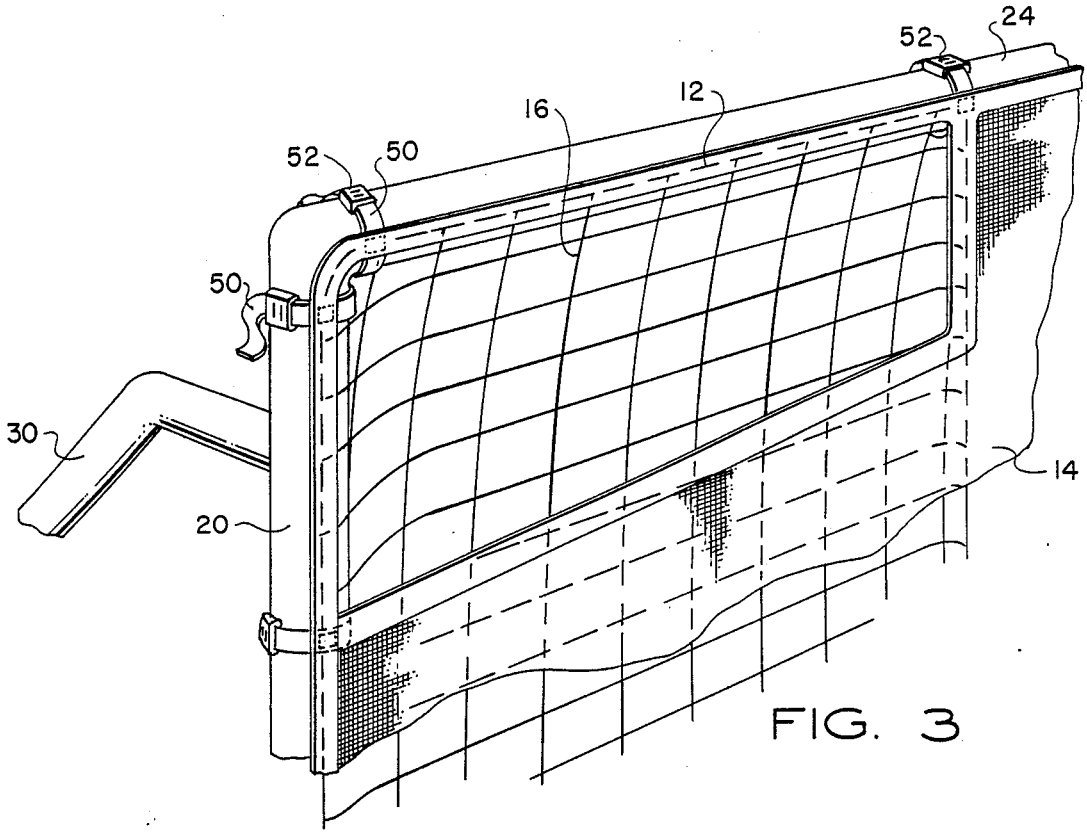
FIG. 3 is a perspective view of the upper left corner portion (as viewed from the perspective of FIGS. 1 and 2) of the soccer goal with the training device according to the present invention attached thereto.

Referring to FIGS. 3 and 5, the elongated strips comprising frame member 12 have opposite major surfaces. Backing member 16 is attached to one of the major surfaces of frame member 12 so that backing member 16 is disposed behind flat member 14. Device 10 is attached to soccer goal 18 by means of a plurality of straps 50 disposed at selected locations along frame member 12 for being wrapped around first and second uprights 20 and 22 and cross member 24 of goal 18. Each strap 50 is equipped with an adjustable fastener 52 to selectively tighten and loosen the fit of corresponding strap 50 around the corresponding member of soccer goal 18. Straps 50 and fasteners 52 allow device 10 to be quickly and easily attached to and detached from soccer goal 18 as desired. The flexible material from which device 10 is manufactured allows device 10 to be folded or rolled to facilitate the transport and storage thereof when device 10 is not in use. The canvas material comprising flat member 14 may be configured with one or more colors as desired. For example, the major portion of flat member 14, including wing portions 42 and 44 and the middle of central portion 40 may be colored white, with elongated strips of green and blue colored material disposed at the top and the bottom, respectively, of central portion 40.

The soccer training device according to the present invention is useful in training soccer players to direct the ball to selected areas of the goal which are the most difficult for a goalie to defend. The device is configured so that only those shots (i.e., kicks or head shots) which enter the desired target area will penetrate through the apertures in the device and enter the goal area. There will be no guesswork or dispute as to whether a shot was properly directed to a target area. The backing member associated with the device stops the forward momentum of the kicked ball and traps the ball between the flat member and backing member to facilitate the retrieval of the ball through one of the target apertures. The backing member also provides a visual representation of the typical soccer goal net, which further enhances the realism associated with the training device. The training device according to the present invention can be quickly and conveniently installed on and removed from the typical soccer goal and can be used on a soccer goal that does not have a net. Another advantage of the device is that it trains the goalie to defend selected portions of the goal represented by the target apertures and not to be overly concerned about guarding the middle of the goal. The goalie is therefore trained to react to the anticipated angle of the shot by moving laterally along the goal and outwardly therefrom to cut off the angle of the shot.

Various embodiments of the invention have now been described in detail. Since it is obvious that changes in and additions to the above-described preferred embodiment may be made without departing from the nature, spirit and scope of the invention, the invention is not to be limited to said details, except as set forth in the appended claims.

What is claimed is:

1. A soccer training device adapted for use in connection with a soccer goal having first and second vertical uprights and a horizontal cross member connecting the uprights for cooperating with a base surface beneath the goal to define a substantially rectangular goal opening, said device being comprised of:

a frame member for being attached to said first and second uprights and said cross member to circumscribe the perimeter of said goal opening;

a relatively flat member coupled to said frame member, said flat member having a central portion extending along a minor axis of said goal opening from said base surface to said cross member and first and second wing portions extending outwardly along a major axis of said goal opening from said central portion to the respective first and second uprights when the frame member is attached to the soccer goal, said central portion being substantially rectangular and said wing portions being tapered from said central portion to the respective uprights, said flat member for being disposed within the perimeter of said goal opening to define selected apertures between said flat member and said frame member representing desired target areas within the goal opening; and a flexible backing member coupled to said frame member for substantially impeding the further progress of a soccer ball after the ball has been propelled through one of the selected apertures in the device, said frame member being comprised of a plurality of flexible elongated strips having first and second opposite major surfaces, said strips being connected to define a substantially rectangular frame member when said frame member is attached to said soccer goal, said backing member being attached to one of said major surfaces of said frame member.

2. The device according to claim 1 wherein said backing member is attached along its perimeter to said frame member, said backing member having a greater area than the area of the goal opening so that the backing member fits loosely on the frame member behind the flat member to define a curved surface.

3. The device according to claim 2 wherein said backing member is configured to absorb the impact of the soccer ball after the ball has been propelled through one of the target apertures so as to substantially impede the further progress thereof and to prevent the ball from being reflected back through the particular aperture through which the ball was initially propelled, thereby trapping the ball between the flat member and backing member to facilitate retrieval of the ball.

4. The device according to claim 3 wherein said backing member is comprised of a net material having a predetermined mesh.

5. The device according to claim 1 wherein said flat member is comprised of a solid flexible material.

6. The device according to claim 1 wherein the central portion of said flat member includes a graphic display representing a soccer goalie who is guarding the goal opening.

7. The device according to claim 1 further including means for attaching the device to the first and second uprights and to the cross member of the soccer goal.

8. The device according to claim 7 wherein said attachment means is comprised of a plurality of straps disposed at selected positions on the device for being wrapped around the corresponding uprights and cross member and a corresponding plurality of fasteners for securing the corresponding straps.

9. The device according to claim 1 wherein said target apertures are comprised of four substantially trapezoidal-shaped openings adjacent to the respective four corners of the rectangular opening, the width of each trapezoidal-shaped opening along the minor axis of the goal opening being greater adjacent to a corresponding upright than the width thereof adjacent to the central portion.

10. A soccer training device adapted for use in connection with a soccer goal having first and second vertical uprights and a horizontal cross member connecting the uprights for cooperating with a base surface beneath the goal to define a substantially rectangular goal opening, said device being comprised of:

a frame member for being attached to said first and second uprights and said cross member to circumscribe the perimeter of said goal opening;

a relatively flat member coupled to said frame member, said flat member having a central portion extending along a minor axis of said goal opening from said base surface to said cross member and first and second wing portions extending outwardly along a major surface of said goal opening from said central portion to the respective first and second uprights when said frame member is attached to said soccer goal, said central portions being substantially rectangular and said wing portions being tapered from said central portion to the respective uprights, said flat member for being disposed within perimeter of said goal opening to define selected apertures between said flat member and said frame member representing desired target areas within the goal opening;

a flexible backing member coupled to said frame member for substantially impeding further progress of a soccer ball after the ball has been propelled through one of the target apertures, said backing member being attached along its perimeter to said frame member, said backing member having a greater area than the area of the goal opening so that the backing member fits loosely on the frame member behind the flat member to define a curved surface, said backing member being configured to absorb the impact of the soccer ball after the ball has propelled through one of the target apertures so as to substantially impede the further progress thereof and to prevent the ball from being reflected back through the particular aperture through which the ball was initially propelled, thereby trapping the ball between the flat member and backing member to facilitate retrieval of the ball, said frame member being comprised of a plurality of relatively flat elongated flexible strips connected to define a substantially rectangular frame when said frame member is attached to the soccer goal, said frame member having first and second opposite major surfaces, said backing member being attached to one of said major surfaces; and means for attaching the device to the uprights and to cross member of the soccer goal.

11. The device according to claim 10 wherein the central portion of the flat member includes a graphic display representing a soccer goalie who is guarding the goal opening.

12. The device according to claim 11 wherein said attachment means is comprised of a plurality of straps disposed at selected positions on the device for being wrapped around the corresponding uprights and cross member of the soccer goal and a corresponding plurality of fasteners for securing the corresponding straps.

13. The device according to claim 12 wherein said central portion is substantially rectangular and said wing portions are tapered downwardly from said central portion to the respective uprights of the soccer goal.

14. The device according to claim 9 wherein said target apertures are comprised of four substantially trapezoidal-shaped openings adjacent to the respective four corners of the rectangular goal opening, the width of each trapezoidal-shaped opening along the minor axis of the goal opening being greater adjacent to the corresponding upright than adjacent to the central portion.

* * * * *